US008641391B2

(12) United States Patent
Pan

(10) Patent No.: US 8,641,391 B2
(45) Date of Patent: Feb. 4, 2014

(54) BUILT-IN ELECTRIC AIR PUMP FOR USE IN INFLATABLE PRODUCTS

(75) Inventor: Erjian Pan, Guangzhou (CN)

(73) Assignee: Foshan Shunde Xinshengyuan Electrical Appliances Co., Ltd (CN)

( * ) Notice: Subject to any disclaimer, the term of this patent is extended or adjusted under 35 U.S.C. 154(b) by 315 days.

(21) Appl. No.: 12/979,836

(22) Filed: Dec. 28, 2010

(65) Prior Publication Data

US 2011/0158834 A1 Jun. 30, 2011

(30) Foreign Application Priority Data

Dec. 29, 2009 (CN) ..... 2009 1 0260794

(51) Int. Cl.
*F04D 29/50* (2006.01)

(52) U.S. Cl.
USPC ..... 417/423.14; 417/305; 417/315; 5/706

(58) Field of Classification Search
USPC ..... 417/239, 305, 306, 307, 315, 411, 417/423.14; 5/706
See application file for complete search history.

(56) References Cited

U.S. PATENT DOCUMENTS 6,036,456 A * 3/2000 Peters et al. ..... 417/423.3
6,332,760 B1 12/2001 Chung
6,530,751 B1 * 3/2003 Song et al. ..... 417/26
6,793,469 B2 * 9/2004 Chung ..... 417/411
7,571,500 B2 * 8/2009 Wu ..... 5/173
2006/0085918 A1 * 4/2006 Metzger ..... 5/713
2006/0147320 A1 * 7/2006 Hansen et al. ..... 417/313
2008/0009815 A1 * 1/2008 Grabenkort et al. ..... 604/346
2008/0226476 A1 * 9/2008 Lau ..... 417/411
2010/0014993 A1 * 1/2010 Wang et al. ..... 417/315
2010/0247337 A1 * 9/2010 Tsai ..... 417/239

FOREIGN PATENT DOCUMENTS

CN 2296411 Y 11/1998
CN 2771586 Y 4/2006
CN 201050491 Y 4/2008

* cited by examiner

*Primary Examiner* — Devon Kramer
*Assistant Examiner* — Charles W Nichols
(74) *Attorney, Agent, or Firm* — The Farrell Law Firm, P.C.

(57) ABSTRACT

A built-in electric air pump mounted on an inflatable bed by heat binding or adhesion is provided, and includes a pump housing; an air duct conversion mechanism mounted in the pump housing; a cover assembly covering the pump housing; a switch assembly connected with the air duct conversion mechanism; an air valve assembly disposed on the bottom of the pump housing; and a power source device connected with the switch assembly and powering the air pump. The air pump receives power from combinations of power sources in four different modes, namely, dry batteries, a rechargeable battery pack assembly, a vehicle-mounted power source and an AC adapter which match one another, to drive the pump, thereby forming multiple power source configurations to drive the same set of air pump and enable the same inflatable bed to be used indoors as well as outdoors at any time.

17 Claims, 6 Drawing Sheets

BUILT-IN ELECTRIC AIR PUMP FOR USE IN INFLATABLE PRODUCTS

PRIORITY

This application claims priority under 35 U.S.C. §119(a) to an application filed in the Chinese Patent Office on Dec. 29, 2009 and assigned Serial No. CN 200910260794.4, the content of which is incorporated herein by reference.

BACKGROUND

1. Field of the Invention

The present invention relates to an electric air pump, and particularly to a built-in electric air pump for use in an inflatable product, such as inflatable bed.

2. Description of the Related Art

At present, there are various inflatable beds available in the market. Electric air pumps of these inflatable beds generally employ only AC or DC electric power air pumps to inflate and deflate the inflatable bed. A majority of DC built-in air pumps individually employ dry batteries only to drive a motor to work, and the dry batteries are disposed beside a whole air exchange duct, and a sealed air valve is externally disposed on an external protrusion of a pump housing of the pump, whereby the whole pump is large in size and might impinge and break the inflatable bed during packaging and use thereof.

SUMMARY

An object of the present invention is to provide a novel built-in electric air pump for use in an inflatable bed, wherein the air pump can inflate the inflatable bed and forcedly deflate the inflatable bed as needed, the same set of air pump can be powered by four different power sources, the battery is easy to mount and remove, and simple and convenient to operate, and the air pump can enable the inflatable bed to be used indoors as well as outdoors.

The object of the present invention is achieved and the technical problem is solved by employing the following technical solutions. The present invention provides a built-in electric air pump for use in an inflatable bed, which includes a pump housing; an air duct conversion mechanism including an air duct; a cover assembly covering the housing; a switch assembly connected with the air duct conversion mechanism; air valve assembly unitarily disposed with the air duct panel on a bottom portion of the pump housing; and a power source device connected with the switch assembly and powering the air pump.

The built-in electric air pump for use in the inflatable bed according to the present invention further includes a power source mounting cavity which is unitary with the air duct panel, and is used for mounting various dry batteries or a rechargeable battery pack assembly.

The power source mounting cavity and switch assembly provide at most four kinds of power source devices including a dry battery, a rechargeable battery pack assembly, a vehicle-mounted power source and an AC adapter, wherein the four kinds of power source devices mutually form different combinations to drive the same set of pump.

The air duct conversion mechanism includes an air duct panel press plate and an air duct panel energizing tab respectively mounted on the air duct panel; a motor connected with the air duct panel and covered by a motor cover plate; an impeller mounted on a bottom surface of the air duct panel; an air exchange valve horizontally provided laterally of the air duct panel and connected in a sleeve-like fashion with an air exchange valve spring.

A propelling helical surface is provided on the bottom of the air exchange valve, and an air in-out port is provided in a lower portion of the air exchange valve.

The switch assembly includes a small cover; a plurality of nuts, a switch and a switch-mounted knob respectively disposed on the small cover; a DC socket is disposed on a bottom surface of the smaller cover.

The air valve assembly includes an air valve plug, an air valve spring, an air valve seat, an air valve support rod, a seal flake and an air valve net mask which are connected in a sleeved manner downwardly in turn.

One of the power source devices includes a PCB voltage reduction plate and dry batteries; the PCB voltage reduction plate is provided on one side of the air duct panel and connected to the motor via the air duct panel energizing tab; the dry batteries are provided above the air duct panel and around the motor.

The cover assembly includes a large cover; a cover snap latch, a cover snap button and a snap latch spring respectively disposed on the large cover; and a cover energizing tab mounted on the bottom of the large cover.

One of the power source devices includes a PCB voltage reduction plate and a rechargeable battery pack assembly, wherein the PCB voltage reduction plate is provided on one side of the air duct panel and connected to the motor via the air duct panel energizing tab; the rechargeable battery pack assembly is provided above the air duct panel and around the motor; the rechargeable battery pack assembly is formed by fixedly connecting a top housing, a voltage detecting plate, rechargeable batteries, a bottom housing and an energizing tab downwardly in turn.

The cover assembly includes a battery box cover; a cover snap latch, a cover snap button and a snap latch spring mounted on the battery box cover.

One of the power source devices includes dry batteries which are provided above the air duct panel and around the motor.

The power source device includes power sources in four different forms: dry batteries, a rechargeable battery pack assembly, a vehicle-mounted power source and an AC adapter, to power the motor and impeller to inflate and deflate the inflatable bed.

The rechargeable battery pack assembly is preferably an independent and unitary moveable member, and can be taken out for individual recharging and facilitate replacement; the rechargeable battery pack assembly is mounted above the air duct panel and forms an encompassment with the motor as a center; the rechargeable battery pack assembly is formed by fixedly connecting a top housing, a voltage detecting plate, rechargeable batteries, a bottom housing and an energizing tab downwardly in turn; the top housing of the rechargeable battery assembly is provided with a switch and a DC socket which are independent from each other and through two holes in the battery box cover of the air pump; a user can control the opening and closing of the circuit of the air pump through the above switch; recharging is effected by connecting a vehicle-mounted power source wire or an AC adapter via the DC socket.

One of the power source devices includes an AC adapter which, besides providing a function of directly supplying electrical power for the motor, has a function of recharging the rechargeable battery pack assembly.

By virtue of the above technical solutions, the built-in electric air pump for the inflatable bed according to the present invention has the following advantages:

The air pump according to the present invention can inflate the inflatable bed and forcibly deflate the inflatable bed when needed, and can employ power sources in one to four different modes, namely, the dry batteries, the rechargeable battery pack assembly, the vehicle-mounted power source and the AC adapter which match one another, to drive the same set of pump, wherein the rechargeable battery pack assembly is meanwhile equipped with a voltage detecting plate which can timely detect whether the battery voltage can be enough for work or whether the battery is fully charged. Besides, the rechargeable battery pack assembly is further equipped with a DC socket via which recharging is conducted by a vehicle-mounted power source or an AC adapter supply electrical power. The DC socket is used so that the vehicle-mounted power source can drive the air pump, the AC adapter drive the air pump and the rechargeable battery pack assembly can be recharged. Upon use of the dry batteries or the rechargeable battery pack assembly, they are easy to remove and mount, and simple and convenient to operate and can enable the inflatable bed to be used indoors as well as outdoors.

BRIEF DESCRIPTION OF THE DRAWINGS

The above and other aspects, features and advantages of the present invention will be more apparent from the following detailed description taken in conjunction with the accompanying drawings, in which.

DETAILED DESCRIPTION OF EMBODIMENTS OF THE PRESENT INVENTION

Figure 1:
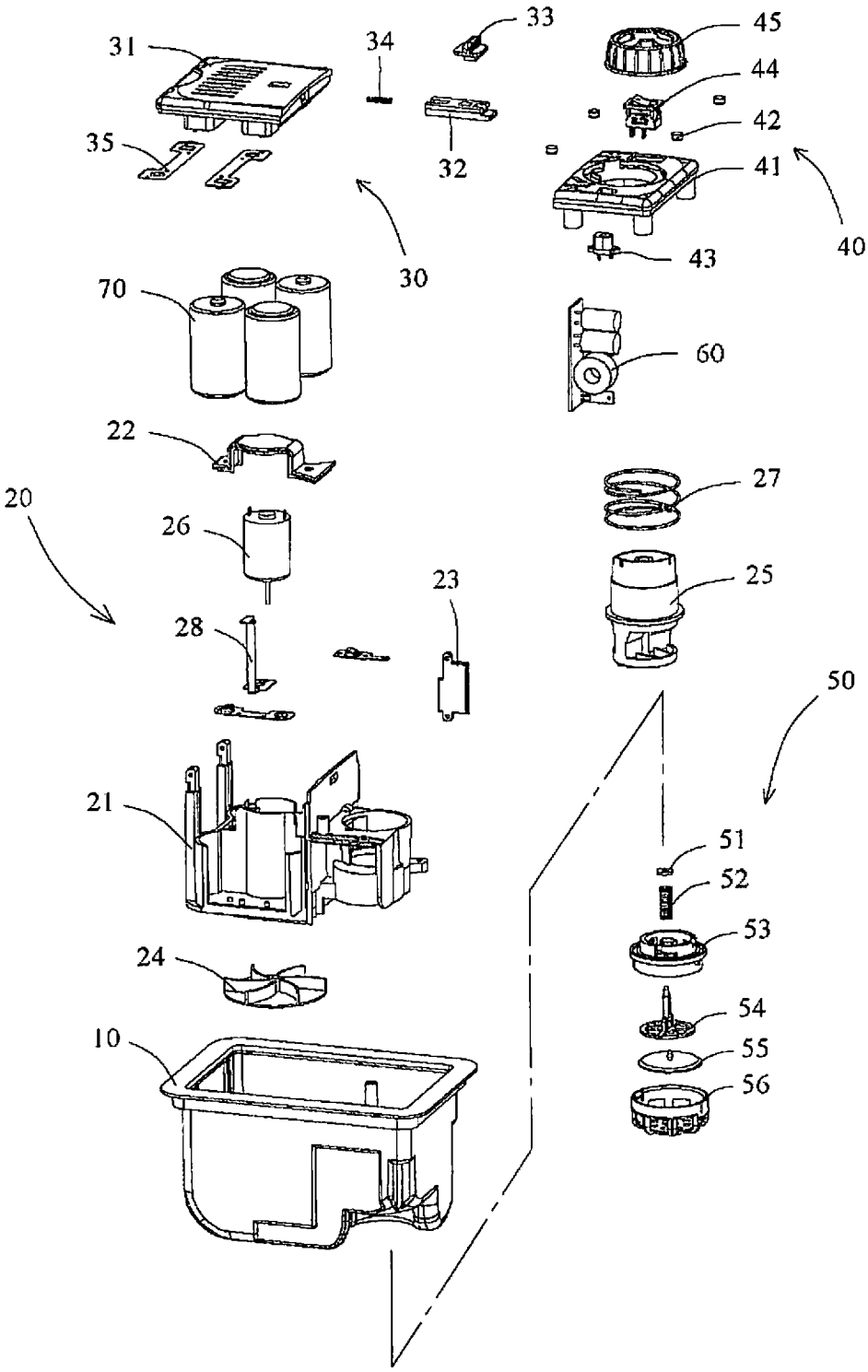
FIG. 1 is an exploded view of a built-in air pump powered by dry batteries or a vehicle-mounted power source according to a first embodiment of the present invention.

In the following description, various specific definitions are provided only to help general understanding of the present invention, and it is apparent to those skilled in the art that the present invention can be implemented without such definitions. Further, in the following description of the present invention, a detailed description of known functions and configurations incorporated herein will be omitted to avoid obscuring the subject matter of the present invention. Throughout the drawings, corresponding reference numerals indicate like or corresponding parts and features.

FIGS. 1-4 are respectively schematic views of four different embodiments (the first to fourth embodiments) of the present invention. A built-in electric air pump for use in an inflatable bed according to the present invention mainly comprises a pump housing 10, an air duct conversion mechanism 20 mounted in the pump housing 10, a cover assembly 30 or cover assembly 30' covering the pump housing 10, a switch assembly 40 connected with the air duct conversion mechanism 20, an air valve assembly 50 disposed on the bottom of the pump housing 10, a power source mounting cavity unitary with the air duct panel, and a power source device powering the air pump.

Figure 6:
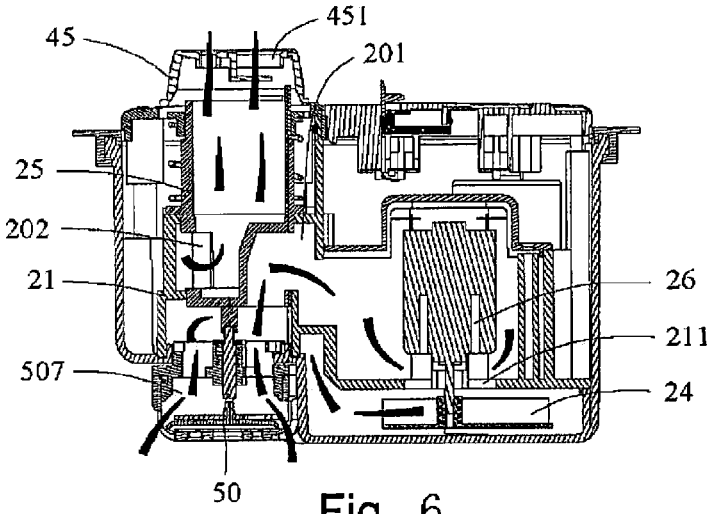
FIG. 6 is a schematic view of an air discharging structure of the built-in air pump demonstrated in the present invention.
Figure 7:
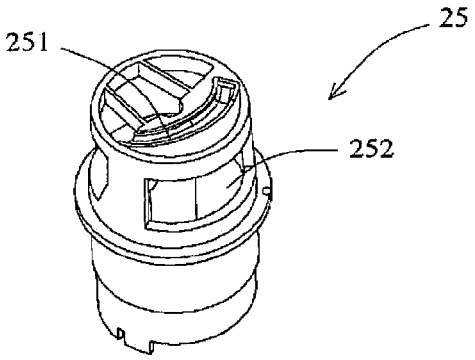
FIG. 7 is a schematic view showing the structure of an air exchange valve.

The air duct conversion mechanism 20 comprises: an air duct panel 21, a motor cover plate 22, an air duct panel press plate 23 mounted on the air duct panel 21, an impeller 24 mounted on a bottom surface of the air duct panel 21, an air exchange valve 25 horizontally provided laterally of the air duct panel 21, a motor 26 provided below the motor cover plate 22, an air exchange valve spring 27 mounted on the air exchange valve 25, and an air duct panel energizing tab 28 mounted on the air duct panel 21. As shown in FIG. 6, a propelling helical surface 251 is provided on the bottom of the air exchange valve 25, and an air in-out port 252 is provided in a lower portion of the air exchange valve 25.

Figure 2:
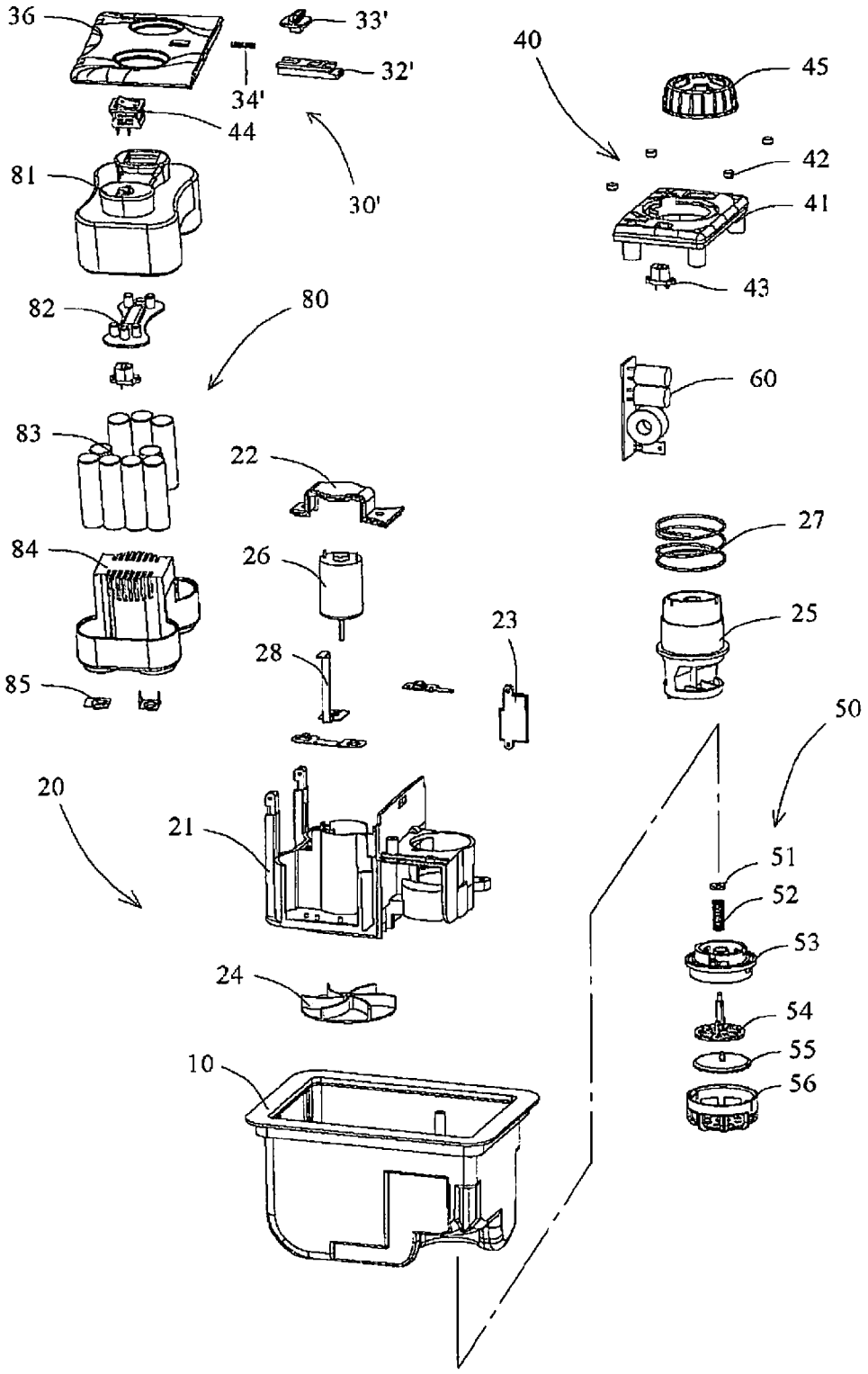
FIG. 2 is an exploded view of a built-in air pump powered by rechargeable batteries or a vehicle-mounted power source or an AC adapter according to a second embodiment of the present invention.
Figure 3:
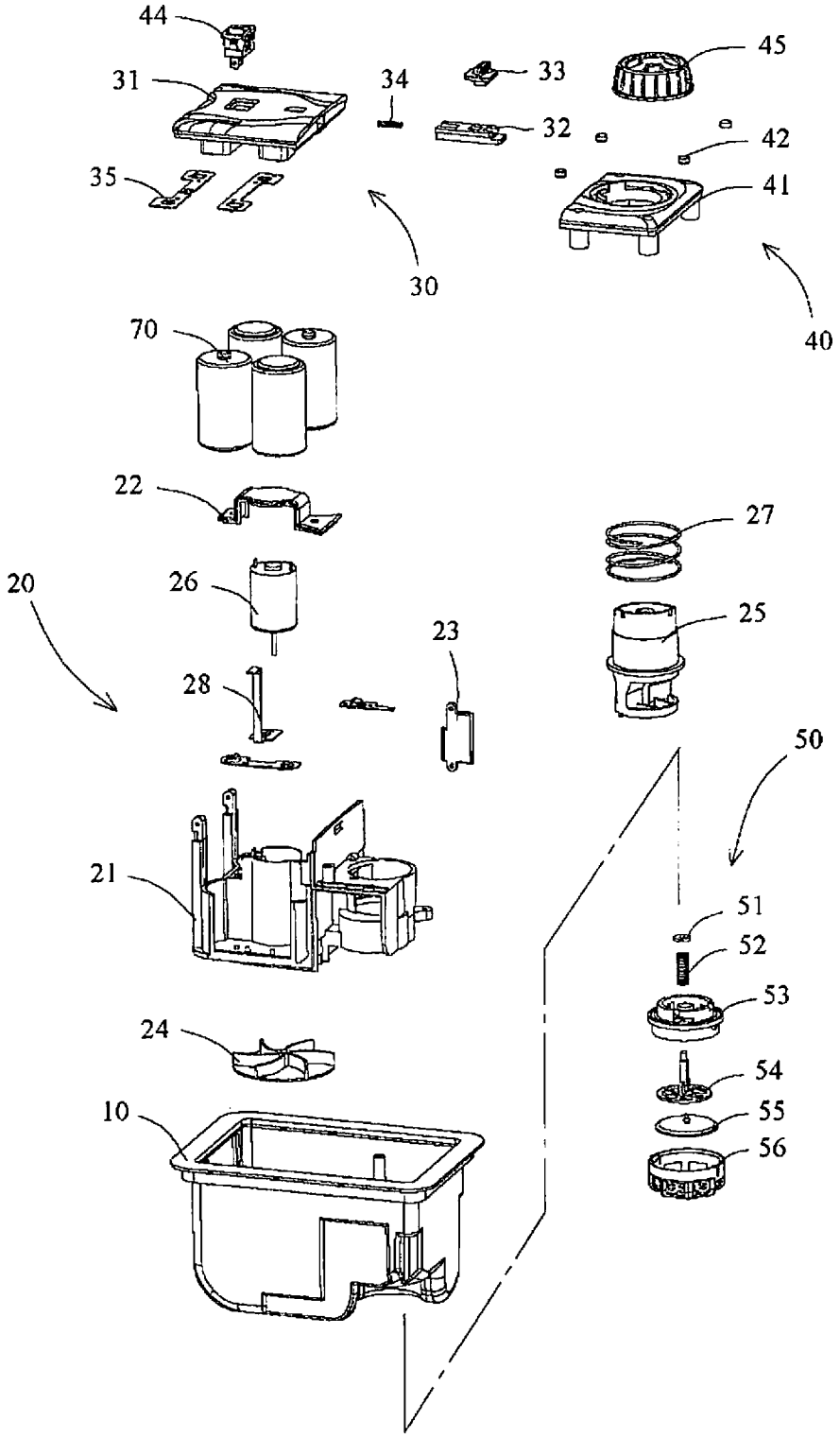
FIG. 3 is an exploded view of a built-in air pump powered by dry batteries according to a third embodiment of the present invention.

The cover assembly 30 comprises: a large cover 31, a cover snap latch 32, a cover snap button 33, a snap latch spring 34 and a cover energizing tab 35. The large cover 31 is provided with the cover snap latch 32, the cover snap button 33 and the snap latch spring 34. On the bottom of the large cover 31 is mounted the cover energizing tab 35. A built-in air pump powered by rechargeable batteries and a vehicle-mounted power source or an AC adapter according to another embodiment of the present invention has another cover assembly 30' (as shown in FIG. 2) and comprises: a battery box cover 36; a cover snap latch 32', a cover snap button 33' and a snap latch spring 34' mounted on the battery box cover 36. The AC adapter of the built-in air pump has a function of directly supplying electrical power for the motor as well as a function of recharging the rechargeable battery box which can be individually taken out for recharging.

The above switch assembly 40 comprises: a small cover 41, a nut 42, a DC socket 43, a switch 44 and a knob 45. A plurality of nuts 42, the switch 44, and the knob 45 mounted on the switch 44 are respectively disposed on the small cover 41; the DC socket 43 is disposed on a bottom surface of the smaller cover 41. Under the action of the knob 45, the air duct panel 21 and the air exchange valve 25 make a radial relative movement to allow the air duct panel 21 and the air in-out port 252 of the air exchange valve 25 to shift, and meanwhile the propelling helical surface 251 on the bottom of the air exchange valve 25 is used to press a sealing air valve open or close the air valve assembly 50 to achieve conversion between air pumping and deflating functions.

The above air valve assembly 50 is comprised of an air valve plug 51, an air valve spring 52, an air valve seat 53, an air valve support rod 54, a seal flake 55 and an air valve net mask 56 which are connected in a sleeved manner downwardly in turn. The air valve plug 51, the air valve spring 52, the air valve seat 53, the air valve support rod 54, the seal flake 55 and the air valve net mask 56 form an air intake and discharging passageway, the sealing air valve is opened under an air pressure or a mechanical force, whereby inflation or deflation is conducted. When the inflatable bed is inflated fully, the air pressure presses the seal flake 55 tightly to prevent air leakage.

A power source device of the built-in electric air pump according to the present invention comprises electrical power source in the following four different forms: dry batteries 70, a rechargeable battery pack assembly 80, a vehicle-mounted power source and an AC adapter, and is used to drive the motor 26 and the impeller 24 to inflate and deflate the inflatable bed.

Figure 8:
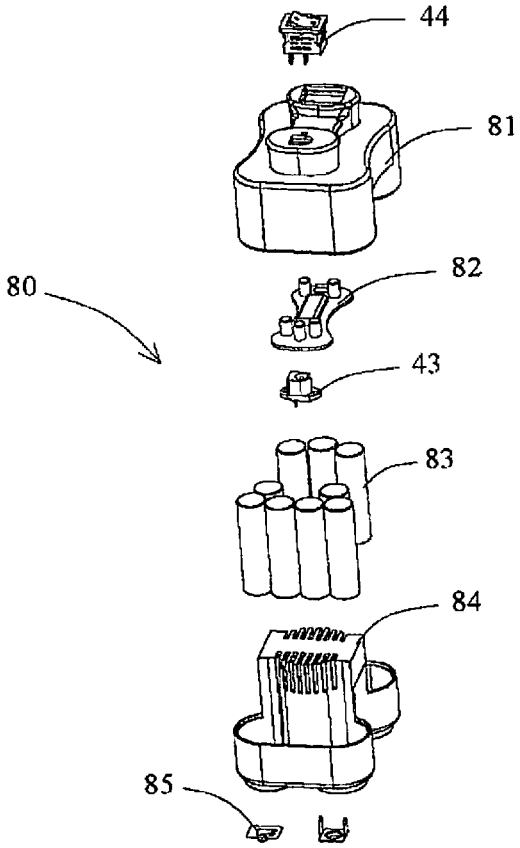
FIG. 8 is an exploded view of a rechargeable battery pack assembly.
Figure 9:
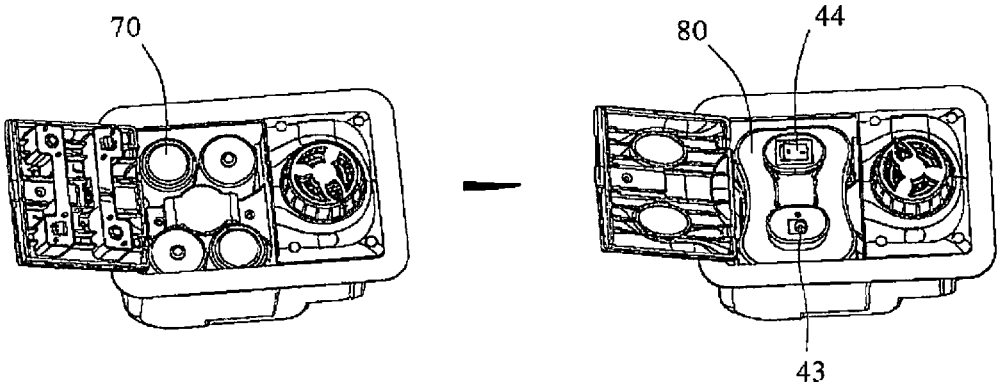
FIG. 9 is a schematic view showing the rechargeable battery pack assembly and batteries mounted in the air pump.

Referring to FIG. 8, the rechargeable battery pack assembly 80 is formed by fixedly connecting a top housing 81, a PCB voltage detecting plate 82, rechargeable batteries 83, a battery box bottom housing 84 and a battery box energizing tab 85 downwardly in turn, wherein the PCB voltage detection plate 82 is connected to positive and negative terminals of the battery and can timely detect whether the battery voltage can be enough for work or whether the battery is fully charged, the DC socket 43 is connected to positive and negative terminals of the battery and both ends of the terminal of the battery box energizing tab 85. When the battery box energizing tab 85 is connected to the motor 26 and activates the switch 44, the rechargeable battery pack assembly 80 supplies power for the motor 26 which drives the impeller 24 to inflate or deflate the inflatable bed. In addition, when an external power source (a vehicle-mounted power source or an AC adapter) is inserted into the DC socket 43, the circuit of the rechargeable battery is disconnected from the motor on one side, and meanwhile the external power source (a vehicle-mounted power source or an AC adapter) is directly connected to the motor and supplies power for the motor to drive the impeller to inflate or deflate the inflatable bed.

A PCB voltage reduction plate 60 is provided on one side of the air duct panel 21 and connected to the motor 26 via the air duct panel energizing tab 28; the dry batteries 70 or the rechargeable battery pack assembly 80 are provided above the air duct panel 21 and around the motor 26. The rechargeable battery pack assembly 80 is provided therein with the PCB voltage detection plate 82 which can timely detect whether the battery voltage can be enough for work or whether the battery is fully charged and equipped with the DC socket 43 (via which recharging is conducted and the vehicle-mounted power source and the AC adapter supply electrical power) and the battery box energizing tab 85, that is, the rechargeable battery pack assembly 80 can provide power source in three different forms for use of the motor, and meanwhile has more than two kinds of external power sources for recharging the rechargeable battery. The above AC adapter, besides a function of directly supplying electrical power for the motor 26, has a function of recharging the rechargeable battery pack assembly 80.

Figure 5:
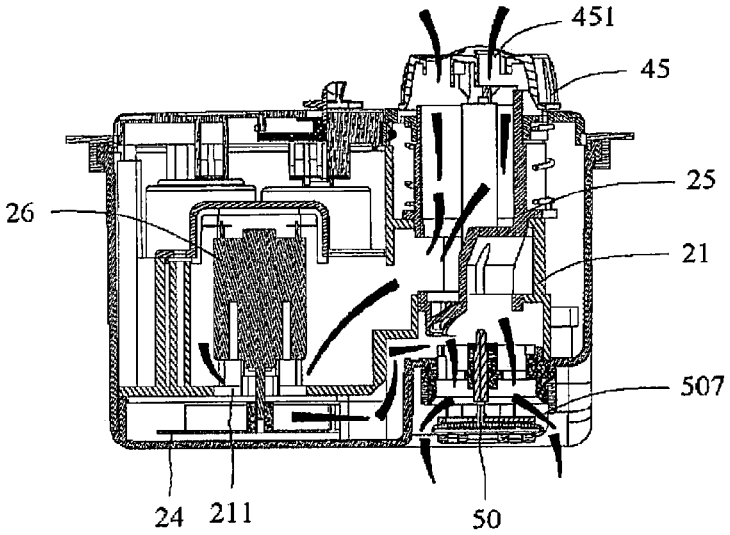
FIG. 5 is a schematic view of an air pumping structure of a built-in air pump demonstrated in the present invention.

Referring to FIG. 5, FIG. 5 is a schematic view of an air pumping structure of a built-in electric air pump powered by power sources of the first, third and fourth embodiments of the present invention. Meanwhile, in combination with FIG. 1, the pump housing 10, the air duct panel 21, the impeller 24 and the motor 26 form a air compression channel; the air duct panel 21, the air exchange valve 25, the air exchange valve spring 27, the small cover 41 and the knob 45 form an air exchange duct; after the dry batteries 70 or the vehicle-mounted power source powers the motor 26 to drive the impeller 24, air enters through an air inlet of the knob 45, into a cavity where the motor 26 is located through the air in-out port 252 of the air exchange valve 25, then into the air compression channel through an air duct port 211, and the wind, under a centrifugal force of the impeller 24, is ejected out to an air valve port 507, thereby inflating the inflatable bed.

Referring to FIG. 6, FIG. 6 is a schematic view of an air discharging structure of the built-in electric air pump powered by the power sources of the first, third and fourth embodiments of the present invention. Meanwhile, in combination with FIG. 1, when the inflatable bed needs to be forcedly deflated, after the dry batteries or the vehicle-mounted power source or AC adapter drives the motor 26 to bring the impeller 24 into motion, air in the inflatable bed will quickly reach the cavity where the motor 26 is located from the sealed air valve port 507, through the sealed air valve assembly 50, and through a ventilation duct 201 formed by the air duct panel 21 and the air exchange valve 25, and enter the air compression channel through the air duct port 211, and wind, under a centrifugal force of the impeller 24, is ejected out to a wind outlet 202 formed by the air duct panel 21 and the air exchange valve 25 into the air exchange valve and finally discharged from the air exchange valve 25 through a wind outlet 451 of the knob 45, finally realizing forced deflation of the inflatable bed.

Figure 4:
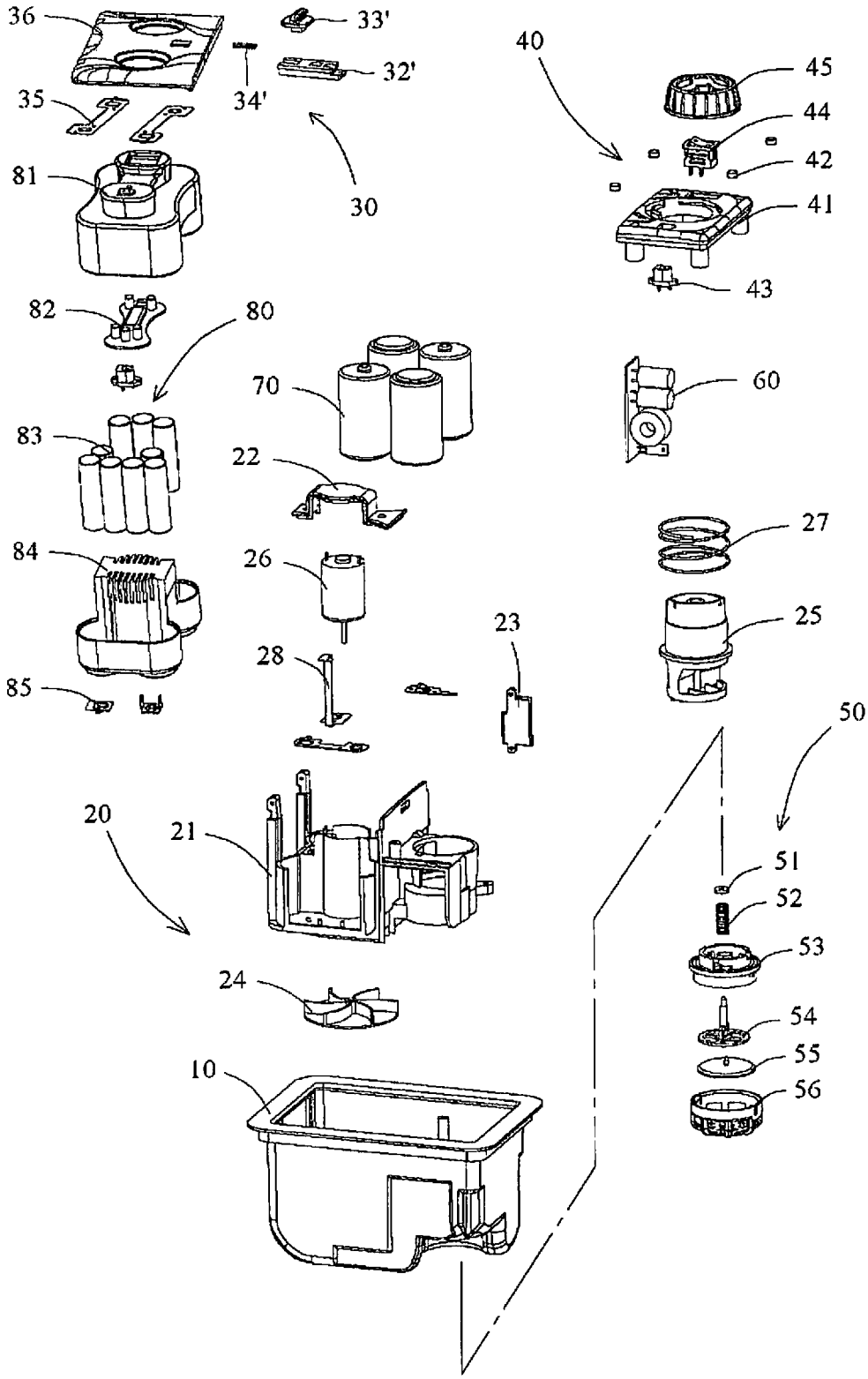
FIG. 4 is an exploded view of a built-in air pump powered by dry batteries, a rechargeable battery pack assembly, a vehicle-mounted power source and an AC adapter according to a fourth embodiment of the present invention.

As shown in FIG. 2, FIG. 4 and FIG. 5, an inflating implementation mode of a built-in electric air pump powered by a rechargeable battery pack assembly or a vehicle-mounted power source or an AC adapter according to the second and fourth embodiments of the present invention can be presented as follows:

The motor 26, the air duct panel 21, the impeller 24 and the pump housing 10 form an air compression channel; the air duct panel 21, the air exchange valve 25, the air exchange valve spring 27, the small cover 41 and the knob 45 form an air exchange duct; after the rechargeable battery pack assembly 80 or the vehicle-mounted power source and the AC adapter powers the motor 26 to drive the impeller 24, air enters through the air inlet of the knob 45, into the cavity where the motor 26 is located through the air in-out port 252 of the air exchange valve 25, then into the air compression channel through the air duct port 211, and the wind, under a centrifugal force of the impeller 24, is ejected out to the air valve port 507, thereby inflating the inflatable bed.

As shown in FIG. 2, FIG. 4 and FIG. 6, a deflating implementation mode of a built-in electric air pump powered by a rechargeable battery pack assembly or a vehicle-mounted power source or an AC adapter according to the second embodiment and fourth embodiment of the present invention can be presented as follows:

When the inflatable bed needs to be forcedly discharged, the rechargeable battery pack assembly 80 or the vehicle-mounted power source or the AC adapter drive the motor 26 to bring the impeller 24 into motion, air in the inflatable bed will quickly reach the cavity where the motor 26 is located from the sealed air valve port 507, through the sealed air valve assembly 50, and through a ventilation duct 201 formed by the air duct panel 21 and the air exchange valve 25, and enter the air compression channel through the air duct port 211, and wind, under a centrifugal force of the impeller 24, is ejected out to a wind outlet 202 formed by the air duct panel 21 and the air exchange valve 25 into the air exchange valve 25 and finally discharged from the air exchange valve 25 through a wind outlet 451 of the knob 45, finally realizing forced deflation of the inflatable bed.

FIG. 2 and FIG. 4 respectively show the second embodiment and the fourth embodiment. When a DC plug of the AC adapter is inserted into the DC socket 43 of the rechargeable battery pack 80, and the switch 44 is activated, the AC adapter directly supplies power to the motor 26 to drive the impeller 24, thereby inflating or deflating the inflatable bed. When the DC plug of the AC adapter is inserted into the DC socket 43 of the rechargeable battery pack assembly 80, and the switch 44 is switched off, the AC adapter turns to directly recharge the rechargeable battery.

FIG. 1, FIG. 2 and FIG. 4 respectively show the first, the second and the fourth embodiments. When a DC plug of the vehicle-mounted power source is inserted into the DC socket 43 of the rechargeable battery pack assembly 80, and the switch 44 is activated, the vehicle-mounted power source directly supplies power to the motor 26 to drive the impeller 24, thereby inflating or deflating the inflatable bed. When the DC plug of the vehicle-mounted power source is inserted into the DC socket 43 of the rechargeable battery pack assembly 80, and the switch 44 is switched off, the vehicle-mounted power source turns to directly recharge the rechargeable battery.

While the invention has been shown and described with reference to certain embodiments thereof, it will be understood by those skilled in the art that various changes in form and details may be made therein without departing from the spirit and scope of the invention as defined by the appended claims.

What is claimed is:

1. A built-in electric air pump for use in an inflatable product, comprising: a pump housing; an air duet conversion mechanism mounted in the pump housing and comprising an air duct panel; a cover assembly covering the pump housing; a switch assembly connected with the air duct conversion mechanism; a power source mounting cavity unitarily structured with the air duct panel; an air valve assembly disposed unitarily with the air duct panel on the bottom of the pump housing; and a power source device connected with the switch assembly and powering the air pump, wherein the air duct conversion mechanism comprises: an air duct panel press plate and an air duct panel energizing tab respectively mounted on the air duct panel; the air duct panel energizing tab acting as a conduit for electrical energy, a motor connected with the air duct panel and covered by a motor cover plate; an impeller mounted on a bottom surface of the air duct panel; and an air exchange valve horizontally provided laterally of the air duct panel and connected in a sleeve-like manner with an air exchange valve spring wherein a propelling helical surface is provided on the bottom of the air exchange valve, and an air in-out port is provided in a lower portion of the air exchange valve.

2. The built-in electric air pump for use in the inflatable bed according to claim 1, wherein the power source mounting cavity unitarily structured with the air duct panel is used to mount various dry batteries or a rechargeable battery pack assembly.

3. The built-in electric air pump of claim 1, wherein the power source mounting cavity and switch assembly provide four kinds of power source devices including dry batteries, a rechargeable battery pack assembly, a vehicle-mounted power source and an AC adapter, and wherein the four kinds of power source devices mutually form different combinations to drive the same set of pump.

4. The built-in electric air pump of claim 3, wherein the four power source devices can be power source of different voltages, and the same set of air pump is driven through a PCB voltage reduction plate in the air pump.

5. The built-in electric air pump of claim 1, wherein the switch assembly comprises: a small cover; a plurality of nuts, a switch and a switch-mounted knob respectively disposed on the small cover; and a DC socket is disposed on a bottom surface of the smaller cover.

6. The built-in electric air pump of claim 1, wherein the air valve assembly is comprised of an air valve plug, an air valve spring, an air valve seat, an air valve support rod, a seal flake and an air valve net mask which are connected in a sleeved manner downwardly in turn.

7. The built-in electric air pump of claim 3, wherein the power source device comprises a PCB voltage reduction plate and dry batteries, the PCB voltage reduction plate is provided on one side of the air duct panel and connected to the motor via the air duct panel energizing tab, and the dry batteries are provided above the air duct panel and around the motor.

8. The built-in electric air pump of claim 7, wherein the cover assembly comprises: a large cover; a cover snap latch, a cover snap button and a snap latch spring respectively disposed on the large cover; and a cover energizing tab mounted on the bottom of the large cover.

9. The built-in electric air pump of claim 3, wherein the power source device comprises a PCB voltage reduction plate and a rechargeable battery pack assembly, wherein the PCB voltage reduction plate is provided on one side of the air duct panel and connected to the motor via the air duct panel energizing tab.

10. The built-in electric air pump of claim 9, wherein the rechargeable battery pack assembly is an independent and unitary moveable member, and can be taken out for individual recharging and facilitate replacement.

11. The built-in electric air pump of claim 10, wherein the rechargeable battery pack assembly is mounted above the air duct panel and forms an encompassment with the motor as a center; the rechargeable battery pack assembly is formed by fixedly connecting a top housing, a voltage detecting plate, rechargeable batteries, a bottom housing and an energizing tab downwardly in turn; and the top housing of the rechargeable battery pack assembly is provided with a switch and a DC socket which are independent from each other and through two holes in a battery box cover of the air pump.

12. The built-in electric air pump of claim 11, wherein the switch is used to control the opening and closing of the circuit of the air pump, and the DC socket is used to connect a vehicle-mounted power source wire or AC adapter to recharge.

13. The built-in electric air pump of claim 9, wherein the cover assembly comprises: a battery box cover; a cover snap latch, a cover snap button and a snap latch spring mounted on the battery box cover.

14. The built-in electric air of claim 3, wherein the power source device is a form of dry batteries which is provided above the air duct panel and around the motor.

15. The built-in electric air pump of claim 9, wherein the cover assembly comprises: a large cover; a cover snap latch, a cover snap button and a snap latch spring respectively disposed on the large cover; and a cover energizing tab mounted on the bottom of the large cover.

16. The built-in electric air pump for use in the inflatable bed according to claim 2, wherein the power source device comprises an AC adapter, directly supplies electrical power for the motor, and recharges the rechargeable battery pack assembly.

17. The built-in electric air pump of claim 1, wherein the inflatable product is an inflatable bed.

* * * * *